United States Patent [19]

Batza et al.

[11] 4,007,023

[45] Feb. 8, 1977

[54] ELECTROSTATIC PRECIPITATOR WITH COLLECTOR-ELECTRODE SPACERS

[75] Inventors: Willi Bätza; Günter Baier, both of Offenbach; Hermann Schmidt, Bergen-Enkheim, all of Germany

[73] Assignee: Metallgesellschaft Aktiengesellschaft, Frankfurt am Main, Germany

[22] Filed: July 11, 1975

[21] Appl. No.: 595,082

[30] Foreign Application Priority Data

July 12, 1974 Germany ..... 2433596

[52] U.S. Cl. ..... 55/112; 55/114; 55/137; 55/143; 55/145; 55/148; 55/149; 55/156; 55/300

[51] Int. Cl.[2] ..... B03C 3/76

[58] Field of Search ..... 55/112, 114, 143, 145, 55/148, 149, 109, 137, 154, 156, 300

[56] References Cited

UNITED STATES PATENTS

| | | | |
|---|---|---|---|
| 1,600,496 | 9/1926 | Weiskopf | 55/112 |
| 2,535,696 | 12/1950 | Richardson | 55/143 |
| 2,705,221 | 3/1955 | Clark et al. | 55/154 X |
| 3,018,844 | 1/1962 | Gonzalez | 55/143 |
| 3,086,341 | 4/1963 | Brandt | 55/300 X |
| 3,362,135 | 1/1968 | Steuernagel et al. | 55/154 X |
| 3,660,968 | 5/1972 | Dyla et al. | 55/148 X |
| 3,729,815 | 5/1973 | Quintilian et al. | 55/112 X |
| 3,803,809 | 4/1974 | Gelhaar et al. | 55/148 |
| 3,877,897 | 4/1975 | Glucksman | 55/145 X |

FOREIGN PATENTS OR APPLICATIONS

| | | | |
|---|---|---|---|
| 1,112,499 | 8/1961 | Germany | 55/112 |
| 835,012 | 5/1960 | United Kingdom | 55/109 |

*Primary Examiner*—Frank W. Lutter
*Assistant Examiner*—Kathleen J. Prunner
*Attorney, Agent, or Firm*—Karl F. Ross; Herbert Dubno

[57] ABSTRACT

A dust-collecting electrostatic precipitator has a housing in which a multiplicity of collecting-electrode walls are provided in transversely spaced parallel relationship and defined between two gas channels. Each wall consists of a plurality of individual collecting-electrode strips whose side edges are hooked loosely into the side edges of adjacent strips so as to prevent relative rotation of the strips. At the top, all the strips of each collecting-electrode wall are secured to a common carrier while, at the bottom, the strips of each electrode wall are connected to a common rapping member or bar. The individual collecting-electrode strips are provided with spacers which are distributed over the height of the strip and project transversely therefrom, each spacer being anchored to one strip and extending across one of the gas channels to terminate just short of an opposing electrode strip while defining a gap therewith. Corresponding spacers are horizontally aligned all across the housing from one sidewall thereof to the other.

6 Claims, 9 Drawing Figures

ELECTROSTATIC PRECIPITATOR WITH COLLECTOR-ELECTRODE SPACERS

FIELD OF THE INVENTION

The present invention relates to dust-collecting electrostatic precipitators and, more particularly, to a dust-collecting electrostatic precipitator whose collecting electrodes are each formed from a multiplicity of profile sheet-metal strips whose lateral edges are linked with the lateral edges of adjoining strips.

BACKGROUND OF THE INVENTION

In published German application Offenlegungsschrift 2,234,368 (see U.S. Pat. No. 3,803,809) and elsewhere, there are described dust-collecting electrostatic precipitators which comprise a housing traversed by the dust-carrying gas stream and provided with a multiplicity of transversely spaced mutually parallel collector-electrode walls which define between them the gas channels. Corona-discharge electrode arrays are generally provided between the collector-electrode walls and a rapping device can be provided to cause collected dust to shed from the collector electrodes and be deposited, in turn, in bins at the base of the precipitator.

In the latter disclosure, the collecting electrodes are made up of individual collecting electrode strips whose adjacent side edges are hooked loosely one into the other and whose tops are all fixed to a common carrier while the bottom ends are tied to a rapping linkage, bar or member which receives the rapping impact. The exposed edges of the end strips of the collecting-electrode walls are, in turn, held against rotation by profile supporting members which embrace these edges or are locked to them in the manner of the edge interlock between adjoining strips, and extend throughout the height of the latter.

This design of the end strips and of the collecting electrode walls or strips has proved to be of advantage in reducing the distortion of the collecting electrode walls in the case of flameless combustion at the gas/-solid interface on the collecting electrodes.

Flameless combination phenomena have been encountered recently with increasing frequency, especially in iron-ore sintering plants, the flameless combustion being caused by the feeding of oil-containing additives, such as rolling-mill scale, to the sintering machines.

Unless the oily substance is burned off completely in the sintering bed, there is some distillation of hydrocarbons which are entrained in the exhaust gases and result in a flameless combustion on the collecting electrodes, particularly during initiation of operation of the electrostatic precipitator or upon termination of operations therewith.

The flameless combustion of hydrocarbons or the like at the aforementioned interfaces can result in local overheating of the collecting electrodes. Since the latter are most frequently cold-rolled profile sheet elements, the heating can result in relieving of internal stresses, thereby causing distortion of the strips. The local distortion may be in the form of bulges or the like.

It has been proposed to eliminate such bulges or to reduce them (printed German Pat. application 2,118,803) by altering the ratio of the width of the collecting electrode to its height. To this end, the strips are divided and the parts of each strip are arranged one above the other and are interconnected by straps or the like. This system is highly expensive and involves the disadvantage that during assembly of the wall or repairs thereof, the strips cannot simply be lifted out of the precipitator but require substantial disassembly of the apparatus and even separation of the parts of the subdivided strips.

Even when the collecting electrode strips are located by lateral profiled supporting members provided at the leading and trailing ends of a collecting electrode wall, as taught in U.S. Pat. No. 3,803,809, a bulging of the collecting surfaces in the plane of the wall cannot be entirely eliminated. A reduction of the discharge gap will reduce the highest permissible voltage which may be obtained so that the efficiency of dust/gas separation will be reduced. Whereas the loose hooking of each electrode strip into an adjacent one in an electrode wall has an equalizing influence too, this influence is not sufficient in electrode walls having dimensions such as are now used, i.e., a height of 10–15 meters, a width of 6 meters, and an area of 30–90 $m^2$ per electrode wall consisting of about 12 collecting electrode strips.

OBJECT OF THE INVENTION

It is an object of the invention to reduce the disadvantages of the prior art and to provide an arrangement by which a substantial distortion or bulging of collecting electrode walls is avoided and which facilitates a removal of the electrodes from each gas passage over the top in case of repairs and ensures that the electrode spacing will be kept within the permissible limits even in case of flameless combustion and the ability of the electrodes to vibrate is not adversely affected.

SUMMARY OF THE INVENTION

This object is accomplished in that individual collecting-electrode strips are provided with spacers, which are distributed over the height and width of the electrode walls and extend through individual gas passages in a row which extends substantially from one side wall of the housing to the other, each of said spacers is secured at one end to a collecting electrode strip and that end of the spacer which is not secured defines an air gap with the opposite collecting-electrode strip.

According to the invention, individual spacers are distributed over the electrode walls. Each spacer is secured to one electrode wall and extends at right angles to said wall through the gas passage close to the opposite collecting electrode without contacting it so that an air gap is left free. This has the advantage that when a given electrode wall is being rapped the intensity of the rapping blow and the propagation of the vibration wall resulting from the rapping blow in the electrode wall is not substantially affected by the spacers. Because the electrodes can vibrate independently of each other, the cleaning of the electrodes is much facilitated. In case of a flameless combustion, however, these spacers prevent a substantial bulging of the collecting electrode wall or strip. Bulging will be prevented or reduced by the spacers because in case of a tendency to bulge, the free end of a spacer gets into direct contact with the opposite collecting electrode so that a further bulging of the collecting electrodes is prevented.

It will be understood that the spacers are distributed over the height of the collecting electrode strips in such a manner that the spacers do not involve any electrical distrubances. This can easily be ensured by a suitable location of the corona electrodes.

According to a further preferred feature of the invention, the profiled spacers are disposed in the middle of the cross-section of the respective profiled collecting electrode strip, provided that the electrodes consist of symmetrical profiles.

All spacers are disposed on the same level and at the same point of the cross-section of adjacent collecting electrode strips and extend in a row substantially from one side wall of the housing to the other but define an air gap of 1–2 mm with each side wall. Two or three of such spacers are suitably disposed in the middle of the profile of a strip and distributed over the height of the electrode wall.

According to a further preferred feature of the invention, the spacers are pivoted to be swung up. When it is required to replace collecting electrode strips, these are pulled out in most cases over the top of the precipitator, when the roof thereof has been opened. For this purpose the spacers are swung up to lie along the collecting electrode strips. This can easily be accomplished by means of a suitable rod, which is introduced from below or above and which is formed at one end as a fork or hook which can interengage with the spacer.

According to a preferred feature of the invention the spacers have enlarged free ends. To prevent a yielding of the collecting electrodes or a canting of the spacers as their free ends engage the collecting electrodes, these free ends are enlarged. In case of tendency of one strip to bulge, this feature ensures a sufficiently large contact surface with the opposite strip.

According to a further feature of the invention, the free ends of the spacers rest on a bracket carried by the opposite collecting electrode. According to another preferred feature the fixed ends of the spacers rest on a bracket carried by the collecting electrode strip.

The dust-collecting electrostatic precipitator thus comprises a housing, and a plurality of upright parallel collecting electrodes in transversely spaced relationship within the housing and defining gas channels between them, each of the collecting electrodes being formed with a common carrier at the top thereof, a rapping member aligned the bottom of the collecting electrode, and a multiplicity of collecting-electrode strips secured at their tops to said carrier and at their bottoms to said members, its strips having adjacent lateral edges loosely hooked one into another, the end strips of each collecting electrode being engaged by profiled supporting members extending over the entire height of the collecting-electrode strips. Spacers are interposed between the individual collecting-electrode strips of the collecting electrodes, each of the spacers projecting from a strip of one collecting electrode toward an opposing strip of another collecting electrode across the channel between them but terminating short of said other strip to define a gap therewith, said spacers lying in horizontal rows spanning said housing between opposing walls thereof.

The provision of the collecting electrode strips with spacers extending between the collecting electrode walls, in accordance with the invention, has the result that thermal distortions of the collecting electrode, which distortions would reduce the discharge gap, are substantially reduced or prevented. The spacers can easily be installed in existing plants without need for major structural alterations. The ability of the electrodes to vibrate remains unaffected so that they can be effectively rapped and cleaned. The spacers may be regularly or irregularly spaced on an electrode wall, depending on the experience gained during operation. In some cases it is suitable to provide these spacers on the trailing portion of an electrode wall, with respect to the direction of flow of the gas, because flameless combustion is most likely to occur in that region.

BRIEF DESCRIPTION OF THE DRAWING

The invention will be explained more in detail and with reference to the drawing, in which.

SPECIFIC DESCRIPTION

Figure 1:
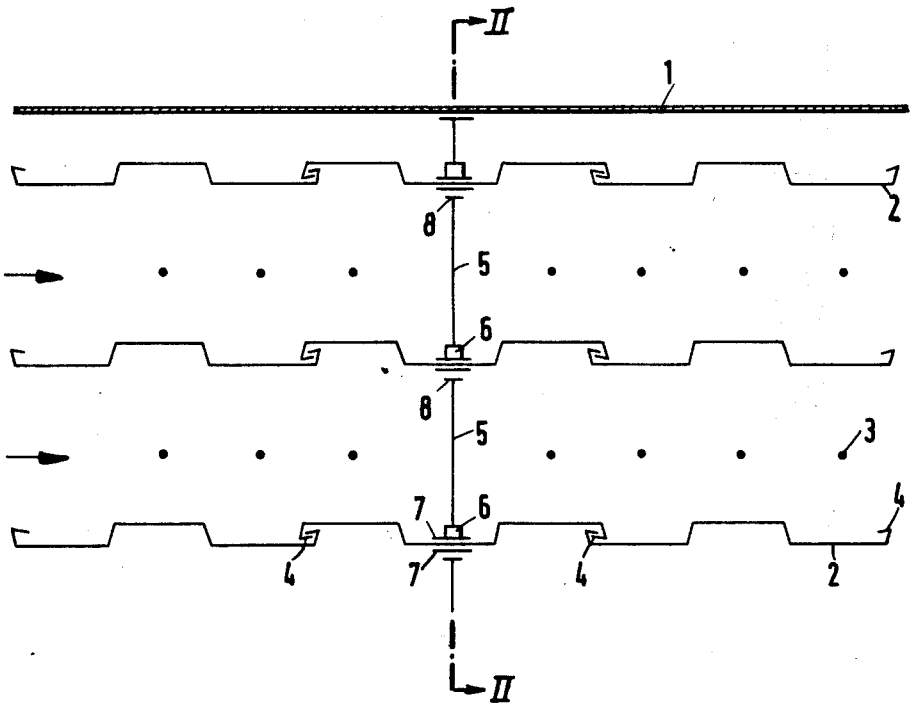
FIG. 1 shows a plurality of gas passages defined by electrode walls as well as the housing wall and the spacers.
Figure 2:
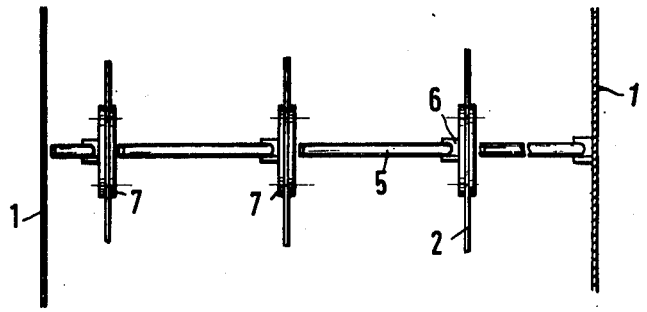
FIG. 2 is a sectional view taken on line II—II of FIG. 1.
Figure 3:
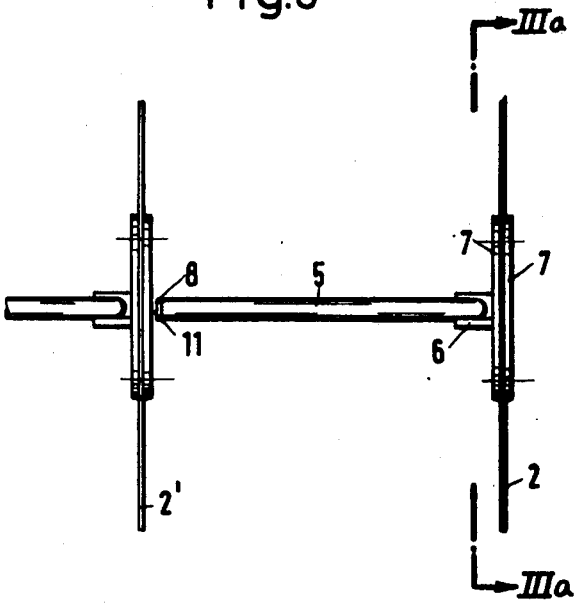
FIG. 3 shows a spacer which is secured to a collecting electrode strip and rests on the opposite collecting electrode strip.
Figure 3A:
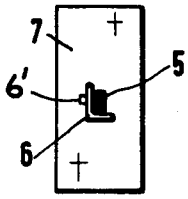
FIG. 3*a* is a sectional view taken on line III*a*—III*a* of FIG. 3.
Figure 4:
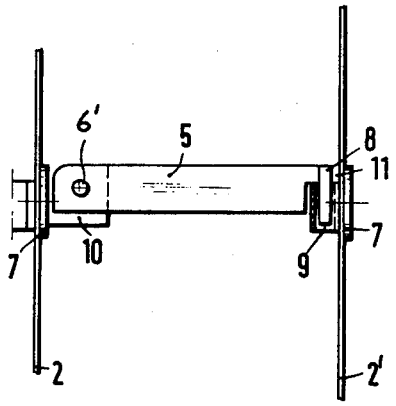
FIG. 4 shows a spacer which is secured to a collecting-electrode strip and rests on the same collecting-electrode strip.
Figure 4A:
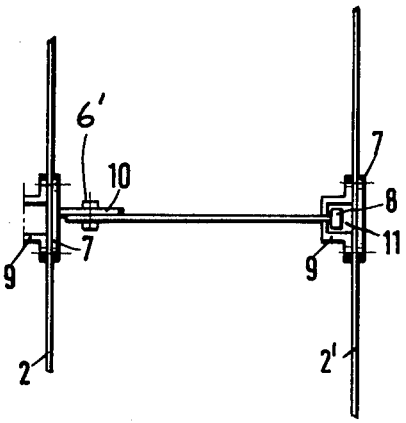
FIG. 4*a* is a top plan view showing the arrangement of FIG. 4.

FIG. 1 shows part of a dust-collecting electrostatic precipitator comprising a housing wall 1, collecting electrode strips 2 and corona electrodes 3 disposed between the collecting electrode strips 2. The parallel rows of collecting electrode strips 2 define gas passages, which are flown through by the gas from which dust is to be collected (see arrow). The collecting-electrode strips 2 are symmetrical and consist each of three trapezoidal parts and side edges 4, which are loosely hooked one into another. A plurality of juxtaposed collecting electrode strips, e.g., the strips 2 or 21, 21' form a collecting-electrode wall. In the middle of some of the electrode strips 2, spacers 5 are provided in accordance with the invention and are hinged to the collecting-electrode strip by means of an associated angle bracket 6 and fixing plate 7 (see FIGS. 1–4*a*). The angle bracket 6 supports the associated spacer at right angles to the collecting electrode strip 2 and has a pivot 6' which permits the spacer to be swung up. The spacers will be swung up particularly when the associated collecting-electrode strip is to be lifted from or installed in the precipitator or for other reasons. When swung up, the spacers 5 extend parallel to the collecting electrode strips in contact therewith. Each spacer 5 has an enlarged free end 8, which provides a contact surface when the opposite electrode tends to deform. An alternative design of the spacers is shown in FIGS. 4 and 4*a*. In this arrangement the free end of each spacer rests on a bracket 9 carried by the opposite collecting electrode strip 2' and the spacer is pivoted to a bracket 10 carried by the collecting electrode strip 2. An air gap 11 of about 1–3 mm is defined between the enlarged free end 8 of the spacer 5 and the adjacent electrode 21.

Figure 5:
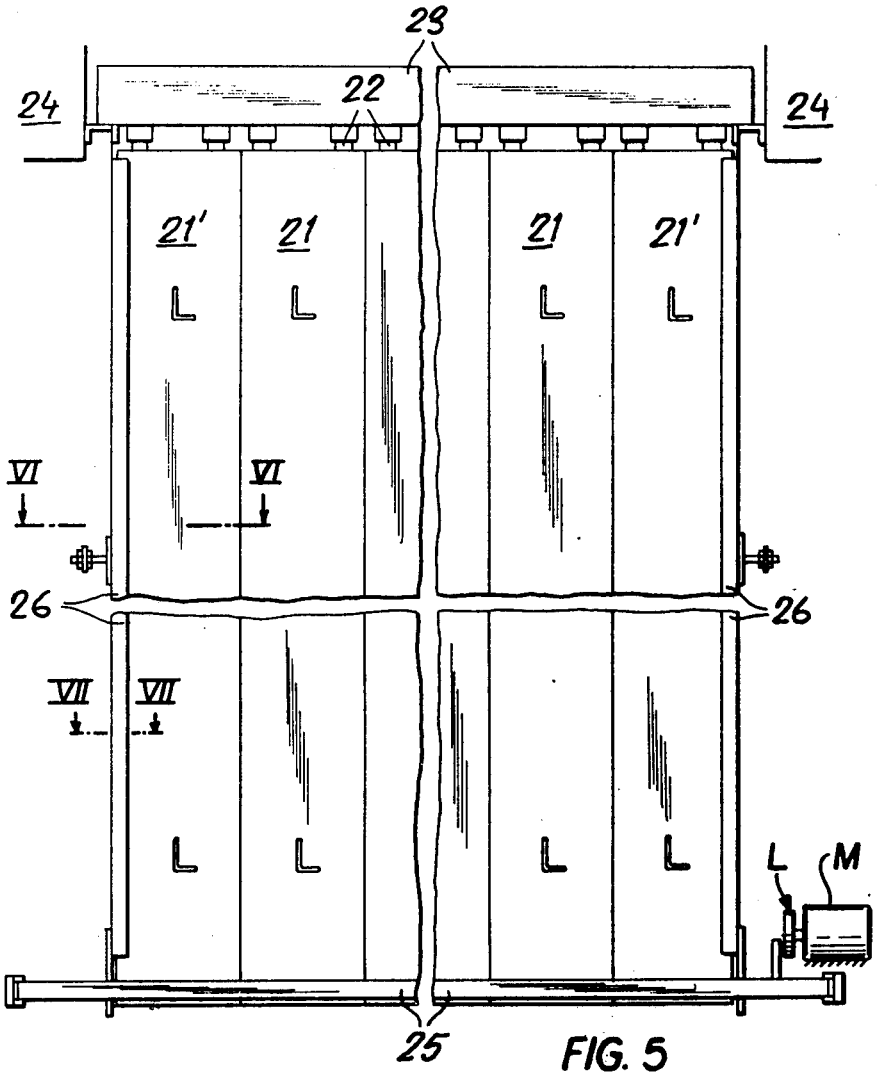
FIG. 5 is an elevational view of a portion of a collector electrode wall in accordance with the present invention.
Figure 6:
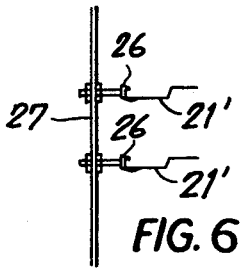
FIG. 6 is a section taken generally along the line VI—VI of FIG. 5.
Figure 7:
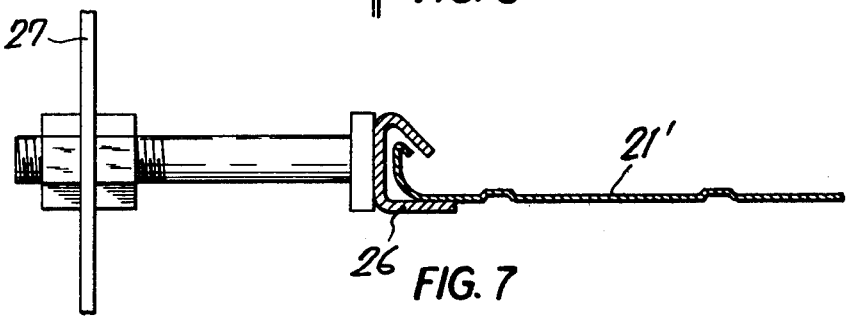
FIG. 7 is an enlarged cross-sectional view taken along the line VII—VII of FIG. 5.

As described in U.S. Pat. No. 3,803,809, FIG. 5 shows a collecting electrode for the electrostatic precipitator utilizing the principles set forth above and in which a plurality of individual collecting electrode strips 21, 21' are provided in mutually adjacent and interlocked relationship. The outermost electrode strips are designated at 21' while the strips intermediate the outermost strips have been indicated at 21.

The collecting electrode strips 21, 21' are cold-rolled profiled steel strip with a height of 15 meters and are identical to one another with the symmetrical profile formed with recesses constituting collecting spaces for dust. The collector electrode strips are secured at their upper ends by strips 22 to a carrier 23 which rests on the housing structure 24 of the electrostatic precipitator. At their lower ends, the collecting electrode strips are connected to a common bar 25 which, in turn, is struck by a conventional rapping linkage L driven by a motor M. The vibration thereby transmitted to the wall formed by the strips 21, 21' releases the accumulated dust which falls into a bin below the bar 25. The free edges of the outermost strips 21' are embraced by the profiled members 26 which loosely surround and are hooked around the profiled outer edges. To prevent the backing members or edge-support members 26 from rotating, they are secured at their top and bottom ends or at intermediate locations to a cross beam 27 which also serves to maintain the distance between adjacent walls.

If any cause, e.g., a flameless combustion, results in a bulging of one of the collecting electrode strips 2, this strip will first hook more firmly into the adjacent electrode strips before the strip under consideration can deform to a larger extent. In case of a tendency toward a further deformation, which would result in a bulging of the generally flat collecting electrode wall, the spacers resist a further decrease of the discharge gap. The enlarged free ends of the spacers engage the collecting electrode wall or strip which tends to deform or the opposite electrode wall or strip and thus resiliently oppose a further deformation.

We claim:

1. A dust-collection electrostatic precipitator comprising:

a housing;

a plurality of upright parallel collecting electrodes in transversely spaced relationship within said housing and defining gas channels between them, each of said collecting electrodes being formed with a common carrier at the top thereof, a rapping member along the bottom of the collecting electrode, and a multiplicity of collecting-electrode strips secured at their tops to said carrier and at their bottoms to said member, said strips having adjacent lateral edges loosely hooked one into another, the end strips of each collecting electrode being engaged by profiled supporting members extending over the entire height of the collecting-electrode strips;

arrays of discharge electrodes between said collecting electrodes;

spacers interposed between the individual collecting-electrode strips of said collecting-electrodes, each of said spacers projecting from a strip of one collecting electrode toward an opposing strip of another collecting electrode across the channel between them but terminating short of said other strip to define a gap therewith, said spacers lying in horizontal rows spanning said housing between opposing walls thereof;

a source of electric potential connected across said discharge and collecting electrodes; and mounting means on each collecting-electrode strip pivotally securing the respective spacer thereto whereby said spacers can be swung up against the respective electrode strip.

2. The electrostatic precipitator defined in claim 1 wherein said spacers are disposed in the middle of the cross section of each respective collecting electrode strip.

3. The electrostatic precipitator defined in claim 1 wherein each of said spacers has an enlarged free end spaced from the opposing collecting electrode strip.

4. The electrostatic precipitator defined in claim 1 further comprising a bracket on each opposing electrode strip adapted to support the free end of a spacer extending theretoward.

5. The electrostatic precipitator defined in claim 1 wherein a bracket is provided on each of said strips carrying the respective spacers and said spacers are receivable in and supported upon said brackets.

6. A collecting-electrode array for an electrostatic precipitator which comprises a plurality of upright parallel collecting electrodes in transversely spaced relationship defining gas channels between them, each of said collecting electrodes being formed with a common carrier at the top thereof, a bar along the bottom thereof and a multiplicity of collecting-electrode strips secured at their tops to said carrier and at their bottoms to said bar, said strips having adjacent lateral edges loosely hooked one into another; and spacers interposed between the collecting-electrode strips of one of said collecting electrodes and the collecting-electrode strips of an opposite collecting electrode and extending across the gas channel between them, said spacers each comprising an elongated bar pivotally mounted at one end to the respective said one of said strips for swinging movement about a respective generally horizontal axis, and means on the respective opposite strip releasably receiving the other end of each bar.

* * * * *